US008261764B2

(12) United States Patent
Miller

(10) Patent No.: US 8,261,764 B2
(45) Date of Patent: Sep. 11, 2012

(54) POWERLESS AIR CHARGING APPARATUS, SYSTEM, AND METHOD

(76) Inventor: John Miller, Green Valley, AZ (US)

( * ) Notice: Subject to any disclaimer, the term of this patent is extended or adjusted under 35 U.S.C. 154(b) by 308 days.

(21) Appl. No.: 12/806,199

(22) Filed: Nov. 2, 2009

(65) Prior Publication Data

US 2011/0100500 A1 May 5, 2011

(51) Int. Cl.
*B67D 7/72* (2010.01)
*F04F 1/00* (2006.01)
*F04F 1/18* (2006.01)

(52) U.S. Cl. ..... 137/206; 137/205.5

(58) Field of Classification Search ..... 137/206, 137/205.5, 565.22, 808, 211; 141/67
See application file for complete search history.

(56) References Cited

U.S. PATENT DOCUMENTS

| | | | | | |
|---|---|---|---|---|---|
| 1,376,359 | A | * | 4/1921 | Quigley | 137/206 |
| 2,509,130 | A | | 5/1950 | Burks | |
| 2,557,724 | A | | 6/1951 | Burks | |
| 2,621,597 | A | * | 12/1952 | Armstrong et al. | 137/211.5 |
| 2,685,297 | A | * | 8/1954 | Clearman | 137/211 |
| 4,475,522 | A | * | 10/1984 | Oonaka | 123/520 |
| 5,131,424 | A | * | 7/1992 | Heidorf et al. | 137/102 |
| 5,309,938 | A | * | 5/1994 | Ellgoth et al. | 137/334 |
| 5,674,312 | A | * | 10/1997 | Mazzei | 95/261 |
| 5,868,945 | A | * | 2/1999 | Morrow et al. | 210/760 |
| 5,901,744 | A | | 5/1999 | Richards | |
| 6,068,778 | A | * | 5/2000 | Steiner et al. | 210/760 |

FOREIGN PATENT DOCUMENTS

CH 430604 2/1967

OTHER PUBLICATIONS

PCT International Search Report and Written Opinion dated Feb. 15, 2011 in PCT/US2010/054824.

* cited by examiner

*Primary Examiner* — Eric Keasel
*Assistant Examiner* — Seth Faulb
(74) *Attorney, Agent, or Firm* — Snell & Wilmer L.L.P.

(57) ABSTRACT

The air charger system provided is configured to provide an air supply to a pressurized water storage system without the use of external power. The system includes a venturi vented to the ambient atmosphere, such that the venturi siphons air from the ambient atmosphere when the venturi reaches a choked flow condition, and the system stores the siphoned air in a charging tank to supply a water storage tank. In various embodiments, the air charger system conserves energy because the use of external power is eliminated. Instead of using a traditional air compressor, the air charger systems converts the potential energy of water in a storage tank to kinetic energy in order to pressurize air in a charging tank. In addition, the air charger system also achieves greater energy conservation with the elimination of an air compressor, such that the system requires less repair and maintenance than a traditional system.

19 Claims, 4 Drawing Sheets

POWERLESS AIR CHARGING APPARATUS, SYSTEM, AND METHOD

FIELD OF INVENTION

The present invention generally relates to powerless charging of liquid storage tanks, and more particularly, to systems, methods, and devices for supplying and storing air in water storage systems without the use of external power.

BACKGROUND OF THE INVENTION

Liquid storage systems vary widely. Pressurized liquid storage systems, sometimes referred to as hydropneumatic tanks, require that the liquid be held in a storage device with a compressed gas. For example, a pressurized water storage system may comprise water, stored in a water storage tank that is supplied with pressurized air. In the past, this air has been supplied by some type of external source that requires separate power and regular maintenance. A typical external compressed gas source may be a compressor or the like. A compressor may have a pump or motor that requires external power or fuel. Further, the sporadic operation and frequent cycling of the pump or motor decreases reliability of the air compressor and requires that the compressor be serviced regularly.

These systems present challenges to water suppliers. Specifically, providing power and continuing maintenance to an air compressor or similar system is expensive and inefficient. As such, there is a need to provide a system capable of supplying gas to a liquid storage system without the use of external power.

SUMMARY OF THE INVENTION

The systems, methods, and devices discussed herein in exemplary embodiments are configured to provide an air supply to a pressurized water storage system without the use of external power. In various exemplary embodiments, the system includes a venturi vented to a gas source, such that the venturi siphons gas from the source when the venturi is subject to a liquid flow condition, and the system stores the siphoned gas in a charging tank to supply a liquid storage system.

In an exemplary embodiment, an air charging system comprises a venturi having an inlet, a vent, and an outlet. The vent of the venturi is in communication with an air source and at least one of the inlet and/or outlet of the venturi. The system also comprises a storage tank coupled to the inlet of the venturi and a charging tank coupled to the outlet of the venturi. The system is configured such that, water from the storage tank is supplied to that venturi, to create an air-water mixture in the venturi which is exhausted to the charging tank.

In an exemplary embodiment, a liquid storage system comprises a liquid storage tank which is coupled to a venturi. The liquid storage system further comprises a charging tank coupled to the venturi and configured to receive a gas-liquid flow from the venturi. The liquid storage system also comprises a liquid supply coupled to the charging tank such that liquid is supplied from the liquid supply through the charging tank to the liquid storage tank.

BRIEF DESCRIPTION OF THE DRAWINGS

A more complete understanding of the present invention may be derived by referring to the detailed description and claims when considered in connection with the Figures, wherein like reference numbers refer to similar elements throughout the Figures, and:

DETAILED DESCRIPTION OF EXEMPLARY EMBODIMENTS

Figure 1:
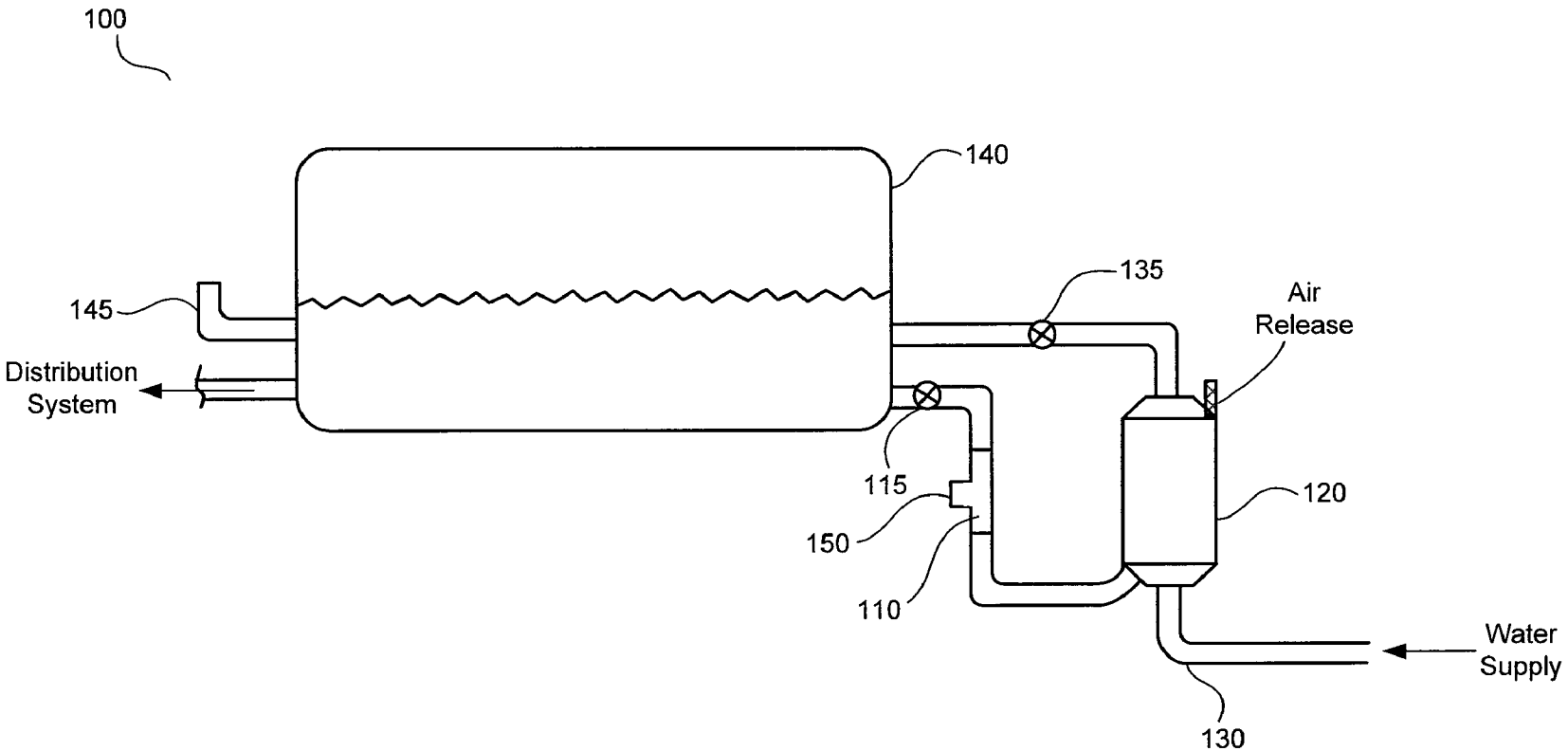
FIG. 1 illustrates an exemplary diagram of a liquid storage system in accordance with an exemplary embodiment.

The following is a description of exemplary embodiments of the invention only, and is not intended to limit the scope or applicability of the invention in any way. Rather, the following description is intended to provide convenient illustrations for implementing various exemplary embodiments of the invention. As will become apparent, various changes may be made to methods, structures, topologies, and compositions described in these exemplary embodiments without departing from the spirit and scope of the invention.

In general, systems, methods, and devices are suitably configured to facilitate supplying gas to liquid storage systems. This supplying may include providing a compressible gas, e.g. air, to a liquid storage system, e.g. a water storage system, to facilitate the supply of pressurized water to a water distribution system. Further, exemplary systems facilitate providing air to water storage systems without the use of external power sources and without loss of liquid volume in the system. As a result, these exemplary systems do not require external equipment to pressurize air, which provides for a water storage and distribution system that is more reliable, more cost effective to operate, and requires less maintenance.

Although described herein in the context of air chargers and water storage systems, it should be understood that the techniques described herein may work in other contexts and that the description herein related to air chargers and water storage systems may be similarly applicable to any apparatus and/or system, wherein stored liquid that must be supplied with a pressurized gas to facilitate distribution. Exemplary gases may include air, hydrogen, oxygen, helium, etc. Exemplary liquids may include water, gasoline, diesel fuel and the like. Similarly, the system may be configured to store compressed gas (e.g., compressed propane, butane or natural gas) and the like.

Air charger systems exist in various configurations, with a variety of components and performance factors. Nevertheless, an exemplary air charger system is briefly described herein. An exemplary air charger system may comprise a venturi, a charging tank, a water supply, and a storage tank. The venturi may be configured to receive a water flow from the storage tank, such that a venturi vent creates an air-water mixture within the venturi. In exemplary embodiments, a valve regulates water flow from the storage tank to the venturi. The air-water is exhausted from the venturi to the charging tank where the air is captured and allowed to pressurize forcing the water in the charging tank back into the water supply. Thereafter, where the water supply is activated and/or a valve at or proximate to the outlet of the charging tank is opened, the air contained within the charging tank is forced into the storage tank by the water supply. Thus, in exemplary embodiments, the system continually creates a captive air source within the charging tank that is supplied to the storage tank, each time water is supplied to the storage tank from the water supply.

In accordance with an exemplary embodiment and with reference to FIG. 1, an air charger system 100 is provided. Air charger system 100 comprises a venturi 110. Venturi 110 is coupled to charging tank 120. Venturi 110 is also coupled to storage tank 140. Charging tank 120 is coupled to water supply 130. Charging tank 120 is also coupled to storage tank 140. Water supply 130 may be coupled to a water source, such as a tank, tower, well, holding pond, irrigation ditch, or any other water source suitable for supplying water to a water storage and distribution system.

In accordance with an exemplary embodiment, air and water must be maintained in storage tank 140 to provide a water supply to a distribution system (not shown). In various exemplary embodiments, the air in the storage tank is maintained at a pressure between approximately 20 psi and 130 psi. In an exemplary embodiment, storage tank 140 may operate with an internal pressure between approximately 60 psi and 70 psi. In an exemplary embodiment, storage tank 140 may operate with an internal pressure between approximately 70 psi and 85 psi. In an exemplary embodiment, storage tank 140 may operate with an internal pressure between approximately 85 psi and 100 psi. To regulate this pressure, an exemplary storage tank may comprise air release 145. Air release 145 may be configured to exhaust pressurized air in storage tank 140. Pressurized air is exhausted when the level of water in the storage tank drops below a certain level exposing the pressurized air to air release 145.

Figure 2:
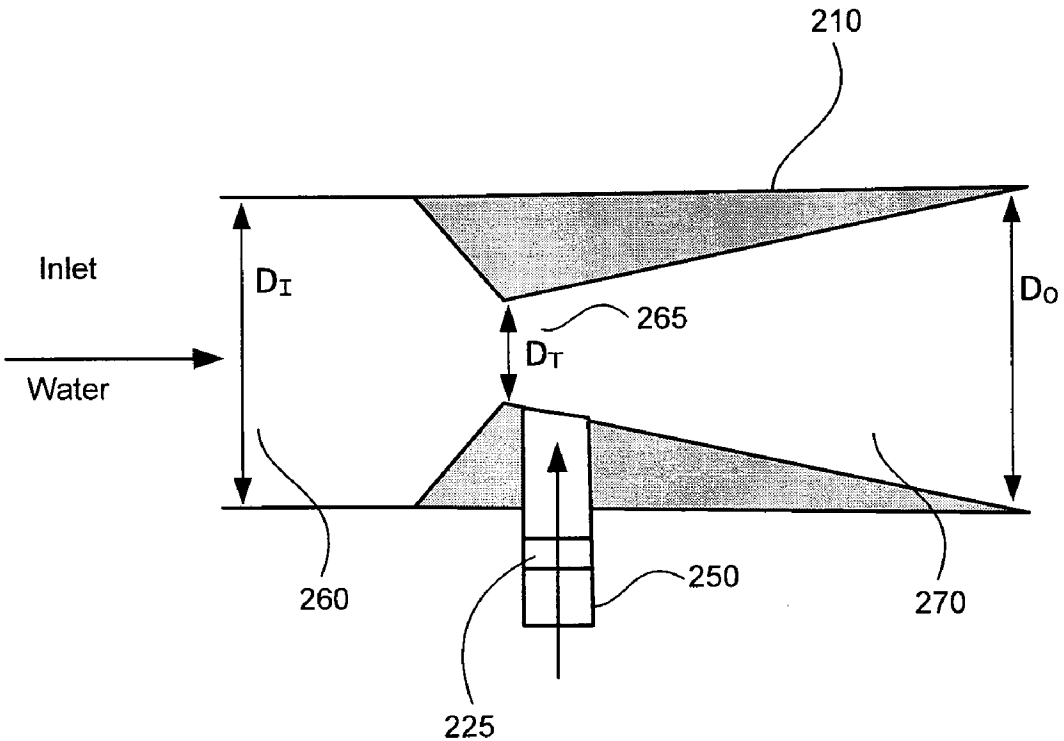
FIG. 2 illustrates a cross-sectional view of an exemplary venturi in accordance with an exemplary embodiment.

In accordance with an exemplary embodiment and with reference to FIG. 2, venturi 210 is provided. Venturi 210 may be any structure or apparatus configured to provide the Venturi Effect when a suitable fluid flow is provided to venturi 210. In an exemplary embodiment, venturi 210 may be an injector, such as, for example a Mazzei injector. Venturi 210 comprises an inlet 260, a throat 265, an outlet 270, and a vent 250. Inlet 260 may be coupled to outlet 270 at throat 265. Further, vent 250 may be coupled to inlet 260 and outlet 270 at throat 265. In various exemplary embodiments, inlet 260 has a diameter, $D_i$ defining an area, $A_i$, throat 265 has a diameter, $D_t$ defining an area, $A_t$, and outlet 270 has a diameter, $D_o$ defining an area, $A_o$. As such, and in exemplary embodiments, $A_i$ is greater than $A_t$ and $A_o$ is greater than $A_t$.

In an exemplary embodiment, vent 250 may comprise a filter 255. Filter 255 any type of filter suitable for removing particulates and contaminants from the air. Filter 255 may be a canister type, paper type, foam type, mesh type, or any other style filter configured to preclude particulates and contaminants from being drawn into vent 250. Filter 255 prevents contamination of the water that passes through the venturi and is ultimately re-introduced into the storage tank to be supplied to the distribution system.

In an exemplary embodiment, inlet 260 may be configured with a supply of a relatively incompressible fluid, e.g. water, such that the water is supplied to $A_i$ of inlet 260 to throat 265 at a first pressure and first flow rate. The water is passed from inlet 260 through $A_t$ at a second pressure and second flow rate. The reduction in area from $A_i$ to $A_t$ causes a pressure drop, such that the second pressure is lower than the first pressure and an increase in flow rate such that the second flow rate is greater than the first flow rate. The pressure drop at throat 265 creates a vacuum and/or suction, causing air to be drawn through vent 250 into the water flow at throat 265. This phenomenon is known as the Venturi Effect. This air-water mixture is exhausted from throat 265 to outlet 270.

Figure 3:
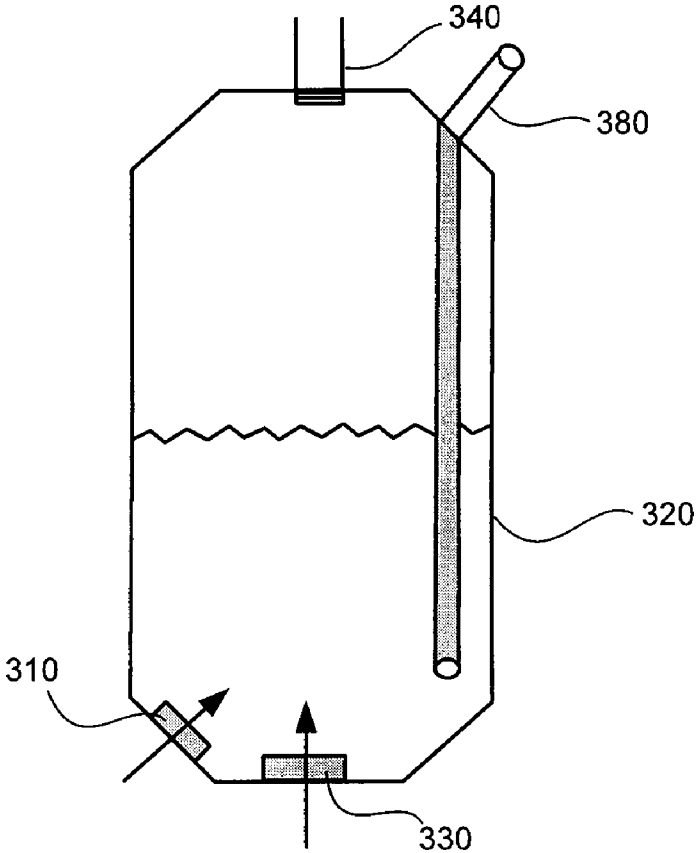
FIG. 3 illustrates a cross-sectional view of an exemplary charging tank in accordance with another exemplary embodiment.

In accordance with an exemplary embodiment and with reference to FIG. 3, charging tank 320 is provided. Charging tank 320 may be any structure configured to capture and store an air-water flow. Charging tank 320 may be made of any material suitable for storing pressurized air and/or water. An exemplary charging tank may be made of cast iron, steel, aluminum, plastic, composite or other suitable materials. In an exemplary embodiment, charging tank 320 may be configured with air release 380. Air release 380 may be a conduit partially installed within charging tank 320. Air release 380 may be a stand alone structure, such as a conduit installed within charging tank 320, or may be integrated within the body of charging tank 320. Similar to charging tank 320, air release 380 may be may be made of any material suitable for conducting pressurized air. An exemplary air release may be made of cast iron, steel, aluminum, plastic, composite or other suitable materials. Charging tank 320 may comprise water supply port 330. Water supply port 330 may be any port configured to couple a water supply to charging tank 320. Charging tank 320 may comprise venturi port 310. Venturi port 310 may be any port configured to couple an air-water supply to charging tank 320. Venturi port 310 may be located anywhere on charging tank 320 that is suitable for coupling a venturi tube and/or hose to charging tank 320. Charging tank 320 may also comprise a storage tank port 340. Storage tank port 340 may be any port configured to couple a conduit configured to transport an air and/or water supply from charging tank 320 to a storage tank. These various ports may be configured with a variety of temporary and/or permanent connectors to facilitate the installation of houses, pipes, and the like. These connectors include, threaded connectors, welded, brazed, or sweated joints, press-fit connectors, and the like.

Figure 4:
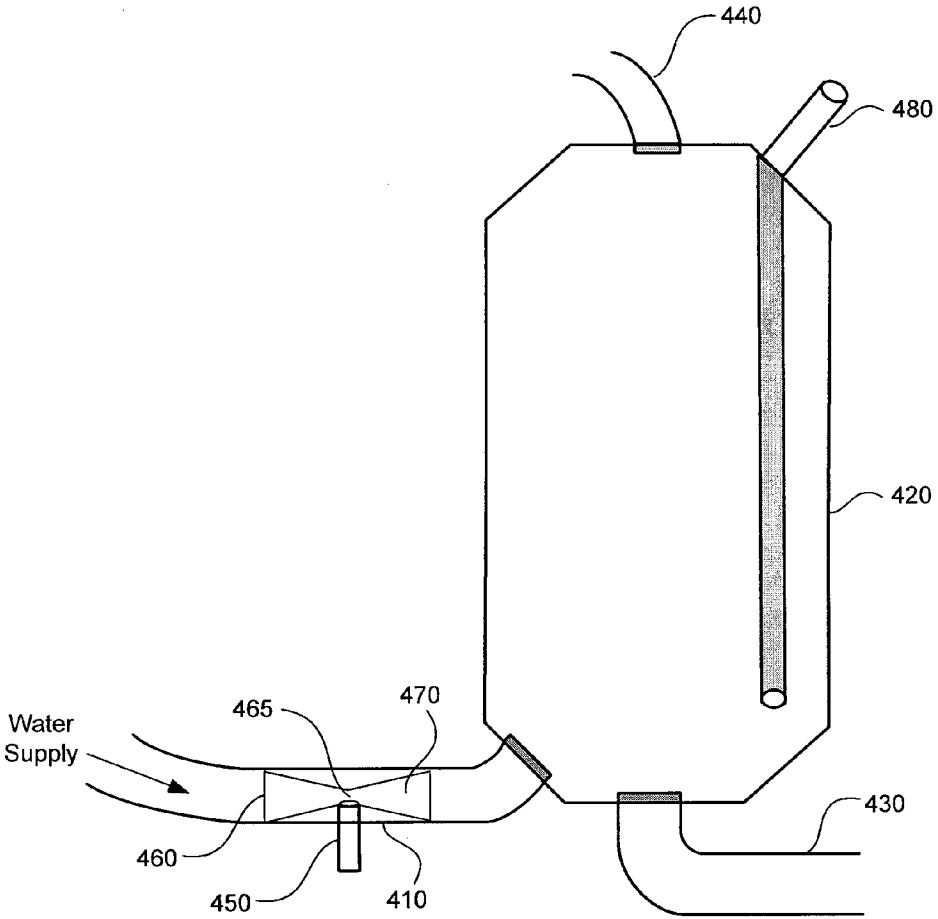
FIG. 4 illustrates an exemplary diagram of an air charger system in accordance with an exemplary embodiment.

In accordance with an exemplary embodiment and with reference to FIG. 4, venturi 410 is coupled to charging tank 420. As discussed above, water is supplied through inlet 460 to throat 465 where a vacuum and/or suction is provided as a result of the Venturi Effect causing air to be introduced through vent 450. Thereafter, the air-water stream is discharged thought outlet 470 into charging tank 420. Charging tank 420 may be a closed system coupled to various valves and other plumbing configurations allowing for air to be captured, stored in charging tank 420 and thereafter discharged. In exemplary embodiments, charging tank 420 is configured to collect the air-water stream and allow the air to separate from the water, wherein the air is maintained in the charging tank. For example air bubbles will generally rise to the top of an air-water mixture. The stream through venturi 410 is maintained to allow air to accumulate and build pressure within charging tank 420, such that water from the air-water stream may be forced back through water supply port 430 in the water supply system (not shown). Charging tank 420 may also comprise a storage tank port 440. Storage tank port 440 may provide for coupling a storage tank (e.g., storage tank 140 as shown in FIG. 1) with charging tank 440. This configuration allows the air in charging tank 420 to be forced through storage tank port 440 to a storage tank by water supplied through water supply port 430.

This configuration allows the venturi to make use of the substantial potential energy of the water stored in the storage tank (e.g., storage tank 140 of FIG. 1), such that the venturi converts the potential energy to kinetic energy in the form of fluid flow with is used to provide and pressurize air in charging tank 420. In this way, air can be supplied to charging tank 420 in a substantially continuous manner. As such, charging tank 420 may be configured to maintain up to a defined volume of air where it is configured with air release 480. This air beyond the volume provided for in charging tank 420 may be discharged through air release 480 at the point that the pressure in charging tank 420 is sufficient to expose the pressurized air volume to the open end of air release 480. Accordingly, the air volume in charging tank 420 may be maintained at a substantially constant level and/or the maximum air volume in charging tank 420 may be limited. In exemplary embodiments, this is useful in preventing air from entering and damaging a water supply pump (e.g., cavitation).

In accordance with an exemplary embodiment and referring again to FIG. 1, charging tank 120 may maintain a volume of air. In an exemplary embodiment, this air is forced into storage tank 140 when water is supplied through water supply 130 through charging tank 120 and into storage tank 140. In another exemplary embodiment, this air is forced into storage tank 140. Further, charging tank 120 is isolated from the storage tank 140 by a valve 135 (e.g., a check valve, a manual valve, a timed valve, a float triggered valve, a ball valve, a pressure valve, etc.) at or proximate to the outlet of the charging tank 120 so that the pressurized air and/or water contained in storage tank 140 does not interrupt operation of venturi 110 and charging tank 120. In yet another exemplary embodiment, this water is provided from storage tank 140 to venturi 110 when a valve 115 (e.g., a manual valve, a timed valve, a float triggered valve, a ball valve, a pressure valve, etc.) is open. Water storage tank 140 comprises substantial potential energy which may be translated to kinetic energy to produce pressurized air when valve 115 is open.

As discussed above, venturi 110 is able to convert the potential energy of the water stored in storage tank 140 to kinetic energy via fluid flow, using the Venturi Effect to introduce air into the water stream. As such, an air-water stream is provided to charging tank 120 and is collected and stored. Thereafter, air from charging tank 120 is provided to storage tank 140 without the use of external power to capture and store the air. In an exemplary embodiment, air charger 100 is a closed system, such that water provided from storage tank 140 through venturi 110 is captured in charging tank 120. The water may be contained within charging tank 120 or forced into water supply 130. Where the water is supplied to storage tank 140, the water exhausted through venturi 110 is recaptured in charging tank 120 and supplied to storage tank 140 as water is supplied through water supply 130. As such, the system is substantially air tight, providing for minimal to no water loss. Further, flow through venturi 110 provides substantially continuous fluid flow between storage tank 140, charging tank 120, and water supply 130, such that the risk of freezing is reduced because of the substantially continuous fluid flow.

The description of various embodiments herein makes reference to the accompanying drawing figures, which show the embodiments by way of illustration and not of limitation. While these embodiments are described in sufficient detail to enable those skilled in the art to practice the invention, it should be understood that other embodiments may be realized and that logical and mechanical changes may be made without departing from the spirit and scope of the invention. Thus, the disclosure herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

Benefits, other advantages, and solutions to problems have been described herein with regard to specific embodiments. However, the benefits, advantages, solutions to problems, and any elements that may cause any benefit, advantage, or solution to occur or become more pronounced are not to be construed as critical, required, or essential features or elements of the invention. The scope of the invention is accordingly to be limited by nothing other than the claims that may be included in an application that claims the benefit of the present application, in which reference to an element in the singular is not intended to mean "one and only one" unless explicitly so stated, but rather "one or more." Moreover, where a phrase similar to "at least one of A, B, and C" may be used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Although certain embodiments may have been described as a method, it is contemplated that the method may be embodied as computer program instructions on a tangible computer-readable carrier and/or medium, such as a magnetic or optical memory or a magnetic or optical disk. All structural, chemical, and functional equivalents to the elements of the above-described embodiments that are known to those of ordinary skill in the art are contemplated within the scope of this disclosure.

What is claimed is:

1. An air charging system configured to maintain a supply of pressurized air in a water tank, comprising:

a water supply;

a charging tank comprising a water supply inlet, a venturi inlet, and a storage tank outlet, wherein said charging tank is configured to receive water from said water supply through said water supply inlet;

a storage tank configured to receive water from said water supply, wherein the water from the water supply inlet conducts air from said charging tank to said storage tank; and a venturi comprising a storage tank inlet, a vent, and a charging tank outlet, wherein said vent is in fluid communication with an air source;

wherein in response to the water supply being active, there is substantially no flow through the venturi, and wherein in response to the water supply being inactive, water from said storage tank is supplied to said venturi, such that said air is siphoned through said vent and introduced to and mixed with said water to create an air-water mixture which is supplied to said charging tank for pressurizing said storage tank.

2. The air charging system of claim 1, wherein air from said air-water mixture is retained in said storage tank.

3. The air charging system of claim 2, wherein said water from said air-water mixture is discharged from said charging tank to a water supply in response to said air being retained in said charging tank.

4. The air charging system of claim 2, wherein said air retained in said charging tank is supplied to said storage tank in response to said water being supplied from a water supply to said storage tank.

5. The air charging system of claim 1, wherein said vent comprises a filter.

6. The air charging system of claim 1, wherein said storage tank further comprises an air release configured to maintain a predetermined minimum level of water.

7. The air charging system of claim 1, wherein said charging tank further comprises an air release configured to maintain a predetermined maximum volume of air.

8. The air charging system of claim 1, wherein a water flow resulting from said water supplied to said venturi provides freeze protection for said storage tank.

9. The air charging system of claim 1, wherein storage tank has an operating pressure range between approximately 20 psi and 130 psi.

10. A liquid storage system having a minimum operating pressure, comprising:

a liquid storage tank;

a venturi coupled to said liquid storage tank and configured to siphon gas from a gas supply in response to a liquid flow through said venturi;

a charging tank coupled to said venturi and configured to receive a liquid-gas flow from said venturi, wherein gas from the liquid-gas flow is retained in the charging tank; and a liquid supply coupled to said charging tank, wherein the liquid is supplied from said liquid supply through said charging tank to said liquid storage tank, and wherein the gas retained in the charging tank is forced into the liquid storage tank to maintain at least a minimum operating pressure;

wherein in response to the liquid supply being active, there is substantially no liquid flow through the venturi, and wherein in response to the liquid supply being inactive, liquid from said liquid storage tank is supplied to said venturi, such that said gas is siphoned from said gas supply and introduced to and mixed with said liquid to create the liquid-gas flow.

11. The liquid storage system of claim 10, wherein the venturi comprises a supply, a vent in fluid communication with a gas source, and an exhaust.

12. The liquid storage system of claim 10, wherein a gas from said liquid-gas flow is collected in said charging tank.

13. The liquid storage system of claim 10, wherein the venturi is configured to receive a liquid flow from said liquid storage tank.

14. The liquid storage system of claim 10, wherein the liquid flow provides freeze protection for the liquid storage system.

15. A method for supplying gas to a liquid storage tank to maintain an operating pressure in said liquid storage tank, comprising:

providing a charging tank coupled to a liquid supply;

providing a storage tank coupled to a charging tank outlet;

providing a venturi coupled to a storage tank outlet and an inlet of said charging tank, wherein said venturi comprises a vent coupled to a gas source;

supplying a liquid flow from said storage tank to said inlet venturi;

siphoning a gas from said gas source in response to said liquid flow; and discharging a liquid-gas flow from said venturi;

wherein in response to the liquid supply being inactive, liquid from the storage tank supplies said liquid flow to the venturi, such that said gas is siphoned to create said liquid-gas flow which is discharged to said charging tank.

16. The method of claim 15, further comprising collecting said gas from said liquid-gas flow in said charging tank.

17. The method of claim 15, wherein said gas drawn through said vent in response to supplying said liquid flow to said inlet.

18. The method of claim 15, wherein the liquid flow to said inlet is substantially constant.

19. The method of claim 16, further comprising, forcing said gas from said charging tank in response to a liquid being supplied from a liquid supply, wherein the charging tank is in fluid communication with said storage tank and said liquid supply.

* * * * *